US009176478B2

(12) United States Patent
Cusin et al.

(10) Patent No.: US 9,176,478 B2
(45) Date of Patent: Nov. 3, 2015

(54) DEVICE FOR ASSEMBLING AND LOCKING A JOINT

(71) Applicant: Nivarox-FAR S.A., Le Locle (CH)

(72) Inventors: Pierre Cusin, Villars-Burquin (CH); Marc Stranczl, Nyon (CH); Daniel Mallet, Le Belieu (FR); Emmanuel Graf, Le Locle (CH)

(73) Assignee: Nivarox-FAR S.A., Le Locle (CH)

( * ) Notice: Subject to any disclaimer, the term of this patent is extended or adjusted under 35 U.S.C. 154(b) by 28 days.

(21) Appl. No.: 14/098,837

(22) Filed: Dec. 6, 2013

(65) Prior Publication Data

US 2014/0160902 A1 Jun. 12, 2014

(30) Foreign Application Priority Data

Dec. 11, 2012 (EP) ..... 12196575

(51) Int. Cl.

| | |
|---|---|
| ***G04B 13/02*** | (2006.01) |
| ***G04B 15/14*** | (2006.01) |
| ***G04B 17/06*** | (2006.01) |
| ***G04D 3/00*** | (2006.01) |
| ***G04B 1/10*** | (2006.01) |

(52) U.S. Cl.

CPC ..... *G04D 3/0041* (2013.01); *G04B 1/10* (2013.01); *G04B 13/022* (2013.01); *G04B 13/02* (2013.01); *G04B 13/021* (2013.01); *G04B 15/14* (2013.01); *G04B 17/063* (2013.01); *Y10T 29/53961* (2015.01)

(58) Field of Classification Search

CPC .... G04B 13/02; G04B 13/021; G04B 13/022; G04B 15/14; G04B 17/063; G04B 1/10; G04D 3/041; Y10T 29/53961

See application file for complete search history.

(56) References Cited

U.S. PATENT DOCUMENTS

| | | | | |
|---|---|---|---|---|
| 7,926,355 | B2 * | 4/2011 | Bannier et al. | 73/760 |
| 2008/0112274 | A1 * | 5/2008 | Bitterli et al. | 368/238 |
| 2009/0263182 | A1 * | 10/2009 | Bannier et al. | 403/242 |
| 2011/0005055 | A1 | 1/2011 | Gigandet et al. | |
| 2012/0090933 | A1 | 4/2012 | Conus et al. | |
| 2012/0186054 | A1 * | 7/2012 | Cusin et al. | 29/225 |

FOREIGN PATENT DOCUMENTS

| | | | |
|---|---|---|---|
| CH | 699 680 | A2 | 4/2010 |
| CH | 704 386 | A2 | 7/2012 |
| EP | 1 850 193 | A1 | 10/2007 |
| EP | 2 273 322 | A1 | 1/2011 |
| EP | 2 442 189 | A1 | 4/2012 |

OTHER PUBLICATIONS

European Search Report issued Jul. 10, 2013 in European Application 12196575, filed on Dec. 11, 2012 ( with English Translation).

* cited by examiner

*Primary Examiner* — Vit W Miska

(74) *Attorney, Agent, or Firm* — Oblon, McClelland, Maier & Neustadt, L.L.P.

(57) ABSTRACT

The invention relates to a system of assembling a member, made of a first material, in the aperture of a part made of a second material having no plastic domain, using an intermediate portion made of a third material, mounted between said member and said part, According to the invention, the intermediate portion is accommodated against a shoulder of the part and is laterally locked in a resilient manner by at least one resilient locking device of the part to secure together the unit comprising the member-intermediate portion-part.

The invention concerns the field of timepieces.

17 Claims, 4 Drawing Sheets

Fig. 2
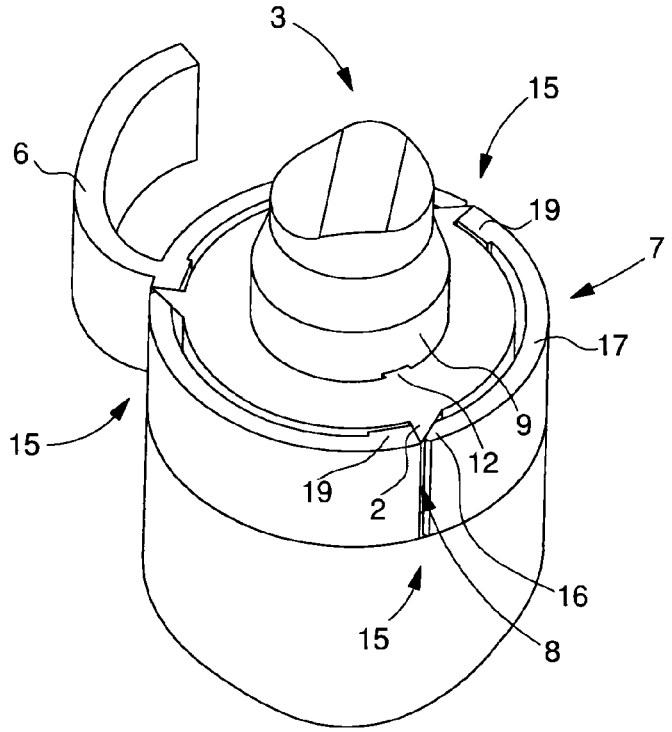
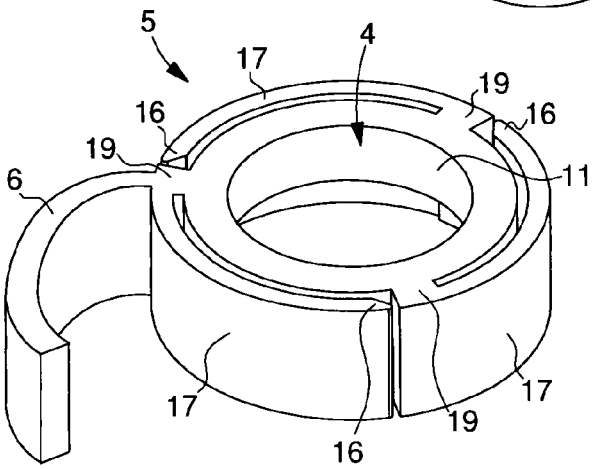
Fig. 3
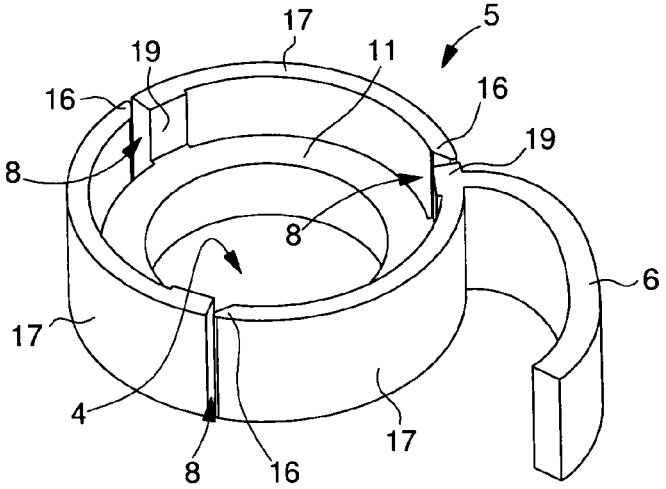
Fig. 4

DEVICE FOR ASSEMBLING AND LOCKING A JOINT

The invention claims priority from European patent application No. 12196575.0 filed on Dec. 11, 2012, the entire disclosure of which is hereby incorporated by reference.

FIELD OF THE INVENTION

The invention relates to a system of assembling a part, made of a material having no usable plastic domain (i.e. very limited plastic domain), to a member comprising a different type of material.

BACKGROUND OF THE INVENTION

Current assemblies including a silicon-based part are generally secured by bonding. This type of operation requires extremely delicate application which makes it expensive.

EP Patent No. 1 850 193 discloses a first, silicon-based part which is assembled on a metal arbour using an intermediate metallic part. However, the shape variants proposed in this document are not satisfactory and either cause the silicon part to break during the assembly thereof, or do not bind the parts sufficiently well to each other.

SUMMARY OF THE INVENTION

It is an object of the present invention to overcome all or part of the aforementioned drawbacks by providing an adhesive-free assembly which can secure a part made of a material with no usable plastic domain to a member comprising a ductile material, such as, for example, a metal or metal alloy.

The invention therefore relates to a system of assembling a member made of a first material in the aperture of a part made of a second material having no usable plastic domain, using an intermediate portion made of a third material, mounted between said member and said part, characterized in that the intermediate portion is arranged to be accommodated against a shoulder of the part and to be locked laterally in a resilient manner by at least one resilient locking device of the part in order to secure the unit comprising the member-intermediate portion-part.

This configuration advantageously enables the unit comprising the part-intermediate portion-member to be secured without bonding to an ordinary, precision controlled member, while ensuring that the part is not subject to destructive stresses, even if it is formed, for example, from silicon.

In accordance with other advantageous features of the invention:

- each resilient locking device includes a cantilever arm of a base integral with the shoulder of the part;
- according to a first embodiment, the arm of each resilient locking device includes a strip, resiliently bent by the intermediate portion, the strip forming an opening which cooperates with a portion of corresponding geometry formed on the external diameter of the intermediate portion to secure the intermediate portion against the part;
- the opening is formed by a free end of each arm facing another base and forming a mortise for cooperating with a beak forming a tenon made on the external diameter of the intermediate portion;
- the opening is formed by a recess in each arm forming a mortise for cooperating with a beak forming a tenon made on the external diameter of the intermediate portion;

- according to a second embodiment, the arm of each resilient locking device includes a strip, resiliently bent by the intermediate portion, the strip forming a beak which cooperates with a portion of corresponding geometry formed on the external diameter of the intermediate portion to secure the intermediate portion against the part;
- the beak is formed by a free end of each arm forming a tenon for cooperating with a mortise recess made on the external diameter of the intermediate portion;
- the beak is formed by a protuberance in each arm forming a tenon for cooperating with a tenon recess made on the external diameter of the intermediate portion;
- the part includes three resilient locking devices;
- the intermediate portion includes at least one stud for driving the member onto the intermediate portion;
- the member has an arbour extended by a shoulder for axially locking the part and the intermediate portion against the member;
- the aperture in the part has a cross-section with a maximum width of between 0.2 mm and 2 mm;
- the aperture in the part has a circular, polygonal or asymmetrical cross-section;
- the second material is silicon-based;
- the third material is formed from a metal or metal alloy base.

Further, the invention relates to a timepiece, characterized in that it includes at least one assembly system according to any of the preceding variants, the part with no usable plastic domain being able to be a wheel, a pallet lever or a balance spring.

BRIEF DESCRIPTION OF THE DRAWINGS

Other features and advantages will appear clearly from the following description, given by way of non-limiting illustration, with reference to the annexed drawings, in which:

FIG. 2 is a perspective view of an assembled assembly system according to the invention;

FIGS. 3 and 4 are partial perspective views of a part according to the invention.

DETAILED DESCRIPTION OF PREFERRED EMBODIMENTS

Figure 1:
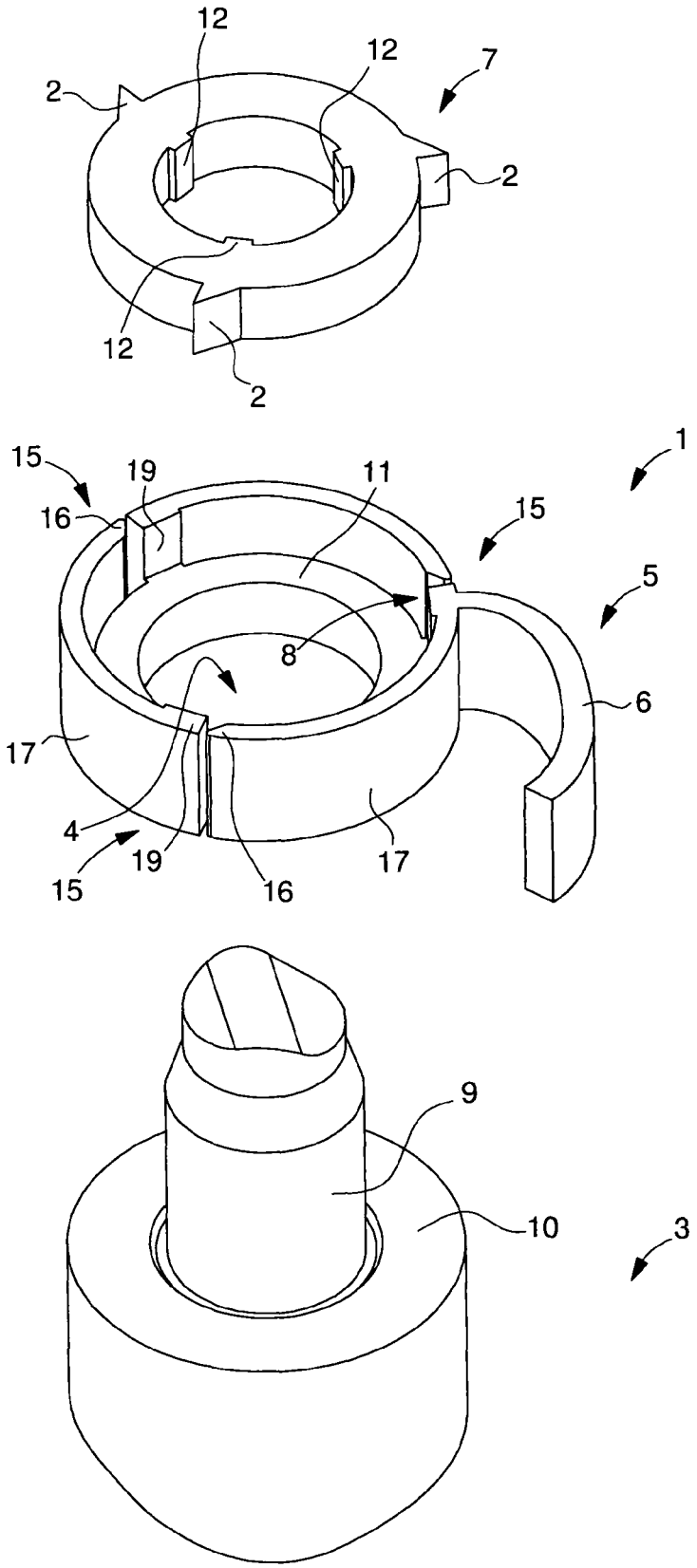
FIG. 1 is an exploded view of an assembly system according to the invention.

As explained above, the invention relates to an assembly system intended to secure a fragile material, i.e. which has no usable plastic domain (i.e. very limited plastic domain) such as a silicon-based material, to a ductile material such as a metal or metal alloy.

This assembly system was devised for applications within the field of horology. However, other domains may very well be envisaged, such as, notably aeronautics, jewellery, the automobile industry or tableware.

In the field of horology, this assembly is required due to the increasing importance of fragile materials, such as those based on silicon such as quartz, crystalline silicon, silicon nitride, silicon carbide or silicon oxide, based on corundum or more generally based on ceramics. By way of example, it is possible to envisage forming the balance spring, balance, pallets, bridges or even wheel sets, such as the escape wheels, completely or partially from a base of fragile materials.

However, always being able to use ordinary steel arbours, the fabrication of which has been mastered, is a constraint which is difficult to reconcile with the use of parts having no usable plastic domain. Indeed, when tests were carried out, it was impossible to drive in a steel arbour and this systematically broke fragile parts, i.e. those with no usable plastic domain. For example, it became clear that the shearing generated by the metallic arbour entering the aperture in a silicon component systematically breaks the component.

The invention relates to a system 1 of assembling a member 3, made of a first material in the aperture 4 of a part 5, made of a second material having no usable plastic domain, using an intermediate portion 7, made of a third material, mounted between member 3 and part 5.

According to the invention, intermediate portion 7 is accommodated against a shoulder 11 of part 5 and is laterally locked in a resilient manner by at least one resilient locking device 15 to secure together the unit comprising member 3-intermediate portion 7-part 5.

As illustrated in FIG. 1, intermediate portion 7 is generally annular. Intermediate portion 7 includes, on the inner diameter thereof, at least one stud 12 for driving member 3 onto intermediate portion 7. Further, intermediate portion 7 includes, on the external diameter thereof, at least one beak 2 (three beaks 2 in FIG. 1) of a resilient locking device 15 for cooperating with an opening 8 (explained above) of part 5. Finally, each stud 12 is preferably located on the same radius as a beak 2 relative to the generally annular surface.

FIG. 1 shows a member 3 according to the invention. Member 3 includes an arbour 9 extended by a shoulder 10 for axially locking part 5 and intermediate portion 7 against member 3. The cross-section of arbour 9 is preferably smaller than that of aperture 4, so that part 5 can slide therein without a friction fit.

Figure 5:
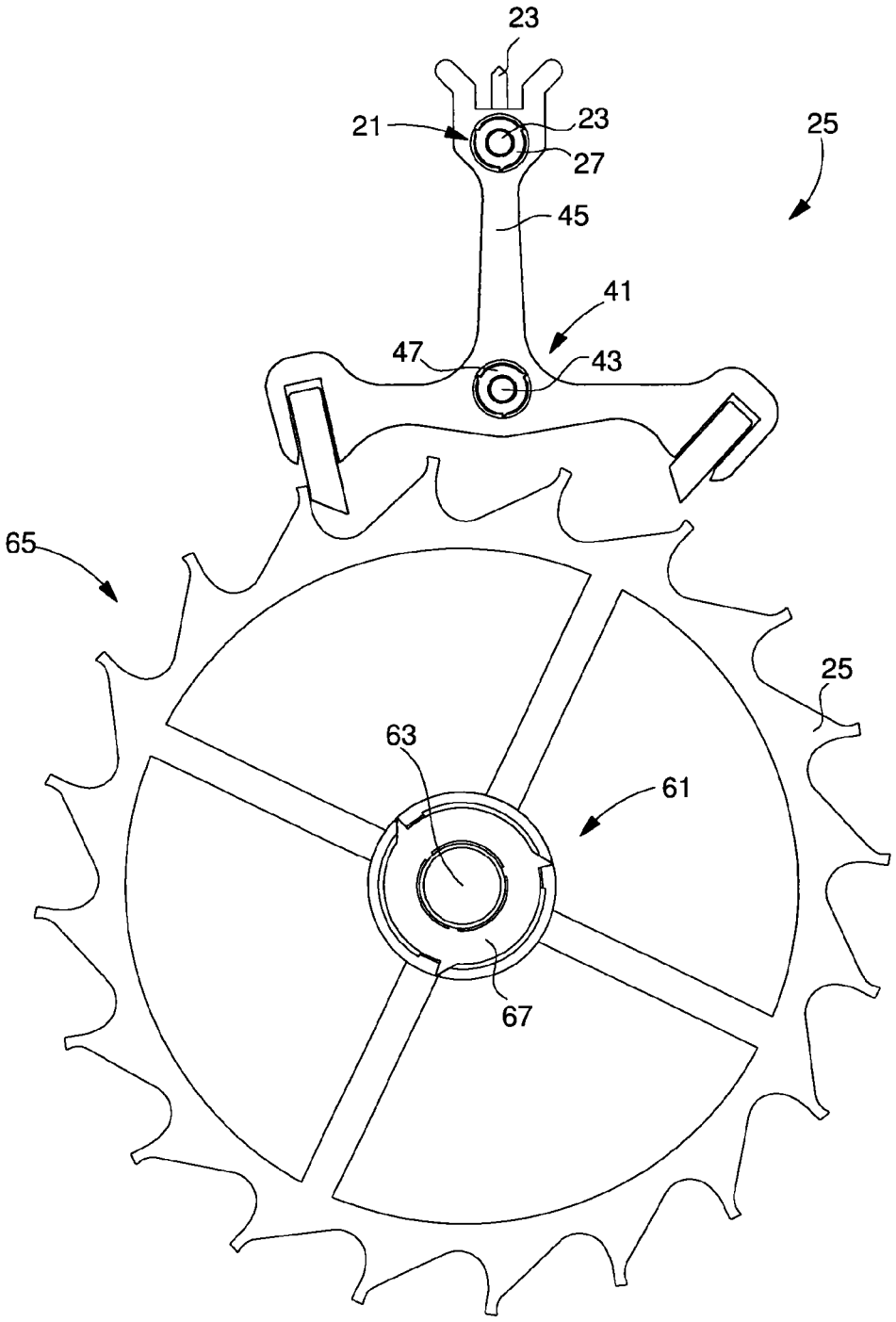
FIG. 5 is a partial, schematic view of a timepiece movement including three assembly systems according to the invention.
Figure 6:
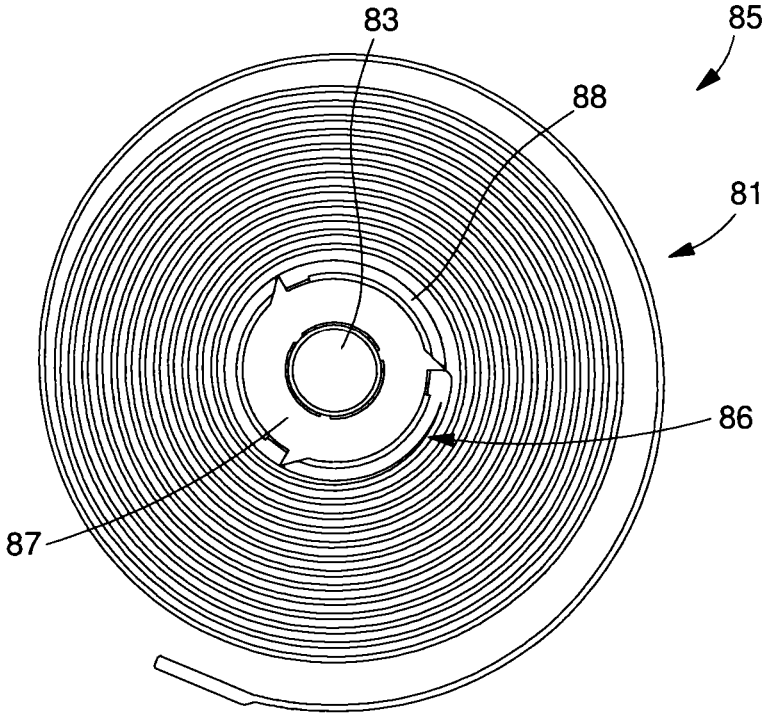
FIG. 6 is a partial schematic view of a timepiece balance spring including an assembly system according to the invention.

As illustrated in FIGS. 1 to 4, part 5 made of a second material with no usable plastic domain is shown with an annular shape having an extension 6. However, as illustrated in FIGS. 5 and 6, this shape is only one portion of part 5 intended to explain assembly system 1. As illustrated in FIGS. 1 to 4, part 5 has a substantially circular aperture 4. Aperture 4 of part 5 preferably has a cross-section with a maximum width of between 0.2 mm and 2 mm.

Advantageously according to the invention, each resilient locking device 15 also includes a beak 2 of intermediate portion 7, a cantilever arm 17 of a base 19 integral with shoulder 11 of part 5. As seen particularly in FIGS. 3 and 4, part 5 preferably includes three resilient locking devices 15.

These Figures also show that arms 17, bases 19 and extension 6 extend over the full height of part 5 while shoulder 11 only extends over one portion of the height thereof and forms aperture 4. Further, each arm 17 includes a free end 16 facing a base 19 leaving an opening 8 whose shape preferably matches that of beaks 2 of intermediate portion 7.

In the example of FIGS. 1 to 4, each opening 8 is formed by one free end 16 and one base 19. Naturally, opening 8 may also be formed solely by a recess in one free end 16 or even by a recess formed at another location on arm 17.

In the example illustrated in FIG. 2, in which the three resilient locking devices 15 are assembled, the arm 17 of each resilient locking device 15 has a strip resiliently bent by intermediate portion 7 and whose free end 16 cooperates with a portion of corresponding geometry formed on the external diameter of intermediate portion 7 to secure intermediate portion 7 against part 5.

Indeed, first of all, intermediate portion 7 is mounted with play partially covering part 5, particularly against shoulder 11, i.e. there is no friction fit when intermediate portion 7 is mounted against part 5. Preferably, each beak 2 of intermediate portion 7 is placed facing an opening 8 of part 5.

Then, in a second step, member 3 is driven against studs 12 of intermediate portion 7. During this second phase, when arbour 9 of member 3 passes, this will push said at least one stud 12 laterally and also each beak 2 which is on the same radius. Each beak 2 will thus move closer to an opening 8 formed between free ends 16 and bases 19, and then push and lock the free end of each associated arm 17, i.e. secure together the unit comprising member 3-intermediate portion 7-part 5. Since arms 17 are cantilevered, it is clear that the locking is resilient, via the lateral displacement of arms 17.

In the example illustrated in FIG. 2, it thus clear that each resilient locking device 15 includes a free end 16 forming a mortise which cooperates with a beak 2 forming a tenon made on the external diameter of intermediate portion 7. Of course, other shapes and/or types of joint and/or an inverted joint and/or alternate different joints may be envisaged with no loss of technical effect. By way of example, one of resilient locking devices 15 could, unlike the others, include a tenon, formed on the free end of an arm, and which cooperates with a mortise formed on the external diameter of the intermediate portion.

Consequently, once the three resilient locking devices 15 have been activated, member 3, intermediate portion 7 and part 5 form an integral unit.

FIGS. 5 and 6 show example applications within the field of watchmaking. In the case of FIG. 5, pallet lever 25, by way of example, includes two assembly systems 21, 41 according to the invention, respectively intended to secure the dart 23 and pivot pin 43 to the lever 45.

As seen in FIG. 5, each assembly system 21, 41 includes an intermediate portion 27,47 cooperating between dart 23 or pin 43 and lever 45 of pallet lever 25. It is thus clear that each assembly system 21, 41 is sufficiently resistant to avoid generating relative movements between its components.

The escape wheel, and more generally wheel 65 includes, by way of example, an assembly system 61 intended to secure a pivot pin 63 to wheel 65. As seen in FIG. 6, assembly system 61 includes an intermediate portion 67 cooperating between pin 63 and wheel 65.

It is thus immediately clear that the example assembly system 61 can be applied to any type of wheel set. Further, pin 63 may comprise a pinion in a single part to form a complete wheel set.

As illustrated in FIG. 6, it is possible to fix a balance spring 85 to a balance staff 83, by using an assembly system 81 of the invention. To achieve this, an intermediate portion 87 is mounted in collet 88 in a similar manner to the above explanations. Collet 88 includes an extension 86 forming coils.

Of course, this invention is not limited to the illustrated example but is capable of various variants and alterations that will appear to those skilled in the art. In particular, aperture 4 in part 5 is in no way limited to a circular cross-section. Thus, other shapes can be envisaged, such as, for example, polygonal or asymmetrical shapes.

What is claimed is:

1. A system of assembling a member, made of a first material, in an aperture of a part made of a second material having no usable plastic domain, using an intermediate portion made of a third material, mounted between said member and said part, wherein the intermediate portion is arranged to be accommodated against a shoulder of the part and to be laterally locked in a resilient manner by at least one resilient locking device in order to secure together a unit comprising the member-intermediate portion-part and wherein each resilient locking device includes a cantilever arm of a base integral with the shoulder of the part.

2. The assembly system according to claim 1, wherein the arm of each resilient locking device includes a strip, resiliently bent by the intermediate portion, the strip forming an opening which cooperates with a portion of corresponding geometry formed on an external diameter of the intermediate portion to secure the intermediate portion against the part.

3. The assembly system according to claim 2, wherein the opening is formed by a free end of each arm facing another base and forming a mortise for cooperating with a beak forming a tenon made on the external diameter of the intermediate portion.

4. The assembly system according to claim 2, wherein the opening is formed by a recess in each arm forming a mortise for cooperating with a beak forming a tenon made on the external diameter of the intermediate portion.

5. The assembly system according to claim 1, wherein the arm of each resilient locking device includes a strip, resiliently bent by the intermediate portion, the strip forming a beak which cooperates with a portion of corresponding geometry formed on an external diameter of the intermediate portion to secure the intermediate portion against the part.

6. The assembly system according to claim 5, wherein the beak is formed by a free end of each arm forming a tenon for cooperating with a mortise recess made on the external diameter of the intermediate portion.

7. The assembly system according to claim 5, wherein the beak is formed by a protuberance in each arm forming a tenon for cooperating with a tenon recess made on the external diameter of the intermediate portion.

8. The assembly system according to claim 1, wherein said part includes three resilient locking devices.

9. The assembly system according to claim 1, wherein the intermediate portion includes at least one stud for driving the member onto the intermediate portion.

10. The assembly system according to claim 1, wherein the member includes an arbour extended by a shoulder for axially locking the part and the intermediate portion against the member.

11. The assembly system according to claim 1, wherein the aperture in the part has a cross-section with a maximum width of between 0.2 mm and 2 mm.

12. The assembly system according to claim 1, wherein the aperture in the part has a circular cross-section.

13. The assembly system according to claim 1, wherein the aperture in the part has a polygonal or asymmetrical cross-section.

14. The assembly system according to claim 1, wherein the second material is silicon-based.

15. The assembly system according to claim 1, wherein the third material is formed from a metal or metal alloy base.

16. A timepiece comprising at least one assembly system according to claim 1.

17. The timepiece according to claim 16, wherein the part with no usable plastic domain is a wheel, a pallet lever or a balance spring.

* * * * *